United States Patent [19]

Bohnes et al.

[11] Patent Number: 4,602,896

[45] Date of Patent: Jul. 29, 1986

[54] CLAMPING CONNECTION DEVICE FOR FLANGED THROUGH SECTIONS OF SUPPORT STRUCTURES

[75] Inventors: Karlheinz Bohnes, Bochum; Lothar Domanski, Oberhausen; Manfred Koppers, Duisburg; Werner Mennekes, Lünen; Dieter Moebus; Rudolf Turowski, both of Bochum, all of Fed. Rep. of Germany

[73] Assignee: Bochumer Eisenhuette Heintzmann GmbH & Co. KG, Bochum, Fed. Rep. of Germany

[21] Appl. No.: 766,815

[22] Filed: Aug. 16, 1985

[30] Foreign Application Priority Data

Aug. 16, 1984 [DE] Fed. Rep. of Germany ..... 3430033

[51] Int. Cl.[4] ..... E21D 11/18

[52] U.S. Cl. ..... 405/288; 403/363; 405/150

[58] Field of Search ..... 405/288, 303; 52/86, 52/732; 403/363

[56] References Cited

U.S. PATENT DOCUMENTS 3,004,637 10/1961 Heintzmann ..... 403/363 X

FOREIGN PATENT DOCUMENTS 968482 4/1958 Fed. Rep. of Germany ..... 405/288
2850350 5/1980 Fed. Rep. of Germany .
1324616 6/1962 France ..... 405/288
1011821 1/1965 United Kingdom ..... 405/288

*Primary Examiner*—Dennis L. Taylor
*Attorney, Agent, or Firm*—Michael J. Striker

[57] ABSTRACT

A clamping device for connecting a number of shaped, elongated, flanged through sections of a support structure to each other includes an upper stirrup, the flanges of which are supported on the flanges of the upper through section, a lower stirrup positioned to support the flanges of the lower through section, and clamping bolts extended through the openings in the flanges of the stirrups and the through sections and tightened with nuts. The head of each bolt has supporting projections provided with convexly curved portions which are engaged in the flanges of the upper stirrup in a form-locking fashion.

7 Claims, 10 Drawing Figures

CLAMPING CONNECTION DEVICE FOR FLANGED THROUGH SECTIONS OF SUPPORT STRUCTURES

BACKGROUND OF THE INVENTION

The present invention relates to a clamping device for connecting flanged through sections of support structures, particularly for mine supports.

Clamping devices of the type under discussion are known. One of such device is disclosed, for example in DE-OS No. 2,850,350. Such a clamping device includes an upper stirrup, a lower stirrup and clamping bolts. In this conventional clamping device clamping bolts are utilized, the heads of which are formed so that they are laterally offset relative to the axes of the bolts towards the free ends of the flanges of the stirrups. The back side of the bolt head of each bolt, facing to the through sections being clamped, extends in the plane of the axis of the bolt. The underside of the head of each bolt lies substantially flush on the flat upper side of the flange of the stirrup. The transition zones between the underside of the bolt head and its back side are convexly curved and are supported in a form-locking manner in the shaped transition regions between the lateral web of the stirrup and its flange. The transition portions between the shaft of the bolt and the underside of its head is sharp-edged and extends vertically. The back side of the bolt shaft, facing the through sections being clamped, extends upwardly up to the plane which is parallel to the end face of the head of the bolt.

The upper stirrup, the lower stirrup and clamping bolts of the clamping device are adjusted to each other so that the head of each bolt smugly lies on the upper stirrup not only in a non-clamped position but also when a certain clamping force is applied to each bolt.

When the clamping force, applied to the clamping bolt, exceeds a predetermined value, particularly when rock pressure is exerted on the mine support, the known clamping device can be subjected to such loads that the free ends of the stirrups can bend in the direction towards the clamping nuts tightening the clamping bolts. Thereby contact surfaces between the heads of the bolts and the upper stirrup are reduced, which results in increase of contact pressures. These high contact pressures are concentrated in the narrow region around the through opening formed in the upper stirrup for passing therethrough of the clamping bolt. Immediate edge region of the opening is therefore extremely highly loaded. This loading is further increased because the portions of the bolt heads, protruding from the bolt shafts in the direction of elongation of the through sections of the support structure, bend towards the end faces of the bolt heads. The highest forces must be transmitted by relatively small contact surfaces. Such extremely high load concentration at the edges of the through openings can easily lead to a premature failure of the whole clamping device so that the upper stirrup would tear up in the region of the opening, or the bolt head would pass through that opening.

Efforts have been made to make the upper stirrup of such material to make the whole clamping device satisfactory. Further material cost reductions have resulted in that the curved regions between the lateral webs of the upper stirrup and its flanges have weakened. However, practically, a material layout in the known device has been a comparatively weak system. This led to the fact that when rock pressures were exerted on the structural components of the clamping devices of the mine supports all the components were subject to considerable deformations. This in turn caused plays between the elements clamped to each other. This effect led eventually to premature malfunctions of each individual mine arch support.

SUMMARY OF THE INVENTION

It is an object of the present invention to provide an improved clamping device for connecting through sections of a support structure to each other.

It is another object of the present invention to provide a clamping device in which a harmonous force flow in the clamping bolts and the stirrups, particularly the upper stirrup, would be ensured, and a long-lasting function of which would be also ensured.

These and other objects of this invention are attained by a clamping device for connecting at least two shaped elongated flanged through sections inserted one into another to form a support structure, comprising a U-shaped, bending-resistant lower stirrup supported in flange recesses of a lower through section and having flange portions provided with through openings; an upper stirrup overlapping a flange of an upper through section and including a longitudinal web, lateral webs, and flange portions formed with through openings; clamping bolts extended through said openings of said upper stirrup and said lower stirrup; and clamping nuts for tightening said bolts, each bolt including a shaft having an axis, a hammer head integral with said shaft and being laterally offset relative to said axis, and a transition portion between said shaft and said head, said head having supporting projections having convexly curved portions, said flange portions of said upper stirrup having curved transition surfaces which engage said curved portions in a form-locking fashion in assembly, said projections having straight-line faces in the direction of elongation of said through sections, said through openings of the upper stirrup being formed in transition zones between said lateral webs and said flange portions and being adjusted to said bolts passing therethrough in the regions of said heads such that before applying a clamping force to each bolt, said shafts are each positioned at a limited distance from a peripheral region of a respective through opening of the upper stirrup, adjacent an end of a respective flange protion, and after applying a clamping force to each bolt, due a relative displacement of said flange portions of said upper stirrup along said supporting projections of said hammer heads, said peripheral region of each through opening comes into contact with said transition portion of each bolt.

The cooperation of the clamping bolts with the recessed flange portions of the upper stirrup leads, upon the application of clamping forces to the bolts, to the fact that the upper sides of the transition zones between the flange portions and the longitudinal web can slide along the convexly curved portions of the supporting projections. Thereby an opening angle between the flange portions and the legs of the upper stirrup is increased unless the edge of the peripheral region of each through opening, receiving the clamping bolt, comes into contact with the portion of the bolt below the hammer head; therefore manufacture and assembly plays between the through openings and the clamping bolts are compensated. The clamping device is rigid and stable. Additional operation loads do not cause breaks. Furthermore, the load-displacement ratio is high.

Due to the minimizing of material consumption for the upper stirrup it is possible that all forces between the upper stirrup and the clamping bolts can flow as in a tie-rod because in the force flow of such a rod no bending-resistant transition areas are necessary. Therefore forces, which can exceed clamping forces can no longer cause damaging strains in the structural components of the clamping device, and thus the disconnection of the through sections from each other. The clamping device functions much longer as well as each individual arch support structure.

The present invention provides an optimal force flow in the individual elements of the clamping device when the same or reduced material application takes place and leads to the increase of maximal carrying loads. It is possible to define and maintain constant resistance to sliding-in with various bending forces. Spring-loaded brakes necessary for bridging the support arch structures are required.

The projections of the head of each bolt have undersides which may be inclined at an acute angle to the axis of the shaft or the bolts. Therefore, after the application of a predetermined clamping force to each bolt, only the free ends of the supporting projections come into abutment with the upper face of the flange portion of the upper stirrup. By respective dimensioning of the bolt head it can be established that, upon the application of a full clamping force to each bolt, a force transmission is concentrated on the end portions of the supporting projections. Thus forces are transmitted at a relatively great distance from the through openings receiving the clamping bolts. Upon a further increase of the clamping force and upon the application of operational loads, the supporting projections can be displaced in the direction of the head surfaces of the bolts. This results in that those further regions of the undersides of the supporting projections come into contact with the flanges of the stirrup, which are positioned closer to the through openings, without, however overloading the edges of these openings. The specific shape of the head of each bolt leads, in case of rock pressures, to the fact that contact surfaces between the heads of the bolts and the upper stirrup are increased and a particular loading of the upper stirrup bn the edges of the openings is drastically reduced. Since the weakest places of the upper stirrup are positioned in the regions of the through openings the cross-section of the upper stirrup can be reduced by the decrease of loading. So the material consumption can be also reduced.

Each supporting portion has an end face, said curved portion upwardly merging into said end face and forwardly merging into said straight-line faces, said flange portions of said upper stirrup being bent toward said longitudinal web.

The head of each bolt has an end surface which includes the end faces of said projections and is convexly curved relative to a plane parallel to said straight-line faces.

Said end surface may project from said shaft by an amount which is defined by a radius which is by about $\frac{1}{3}$ smaller than the radius of said shaft.

Each bolt has a back side facing said through sections, said back side extending vertically up to a plane extending through a half of the height of said head and parallel to said straight-line faces.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

DETAILED DESCRIPTION OF THE PREFERRED EMBODIMENT

Figure 1:
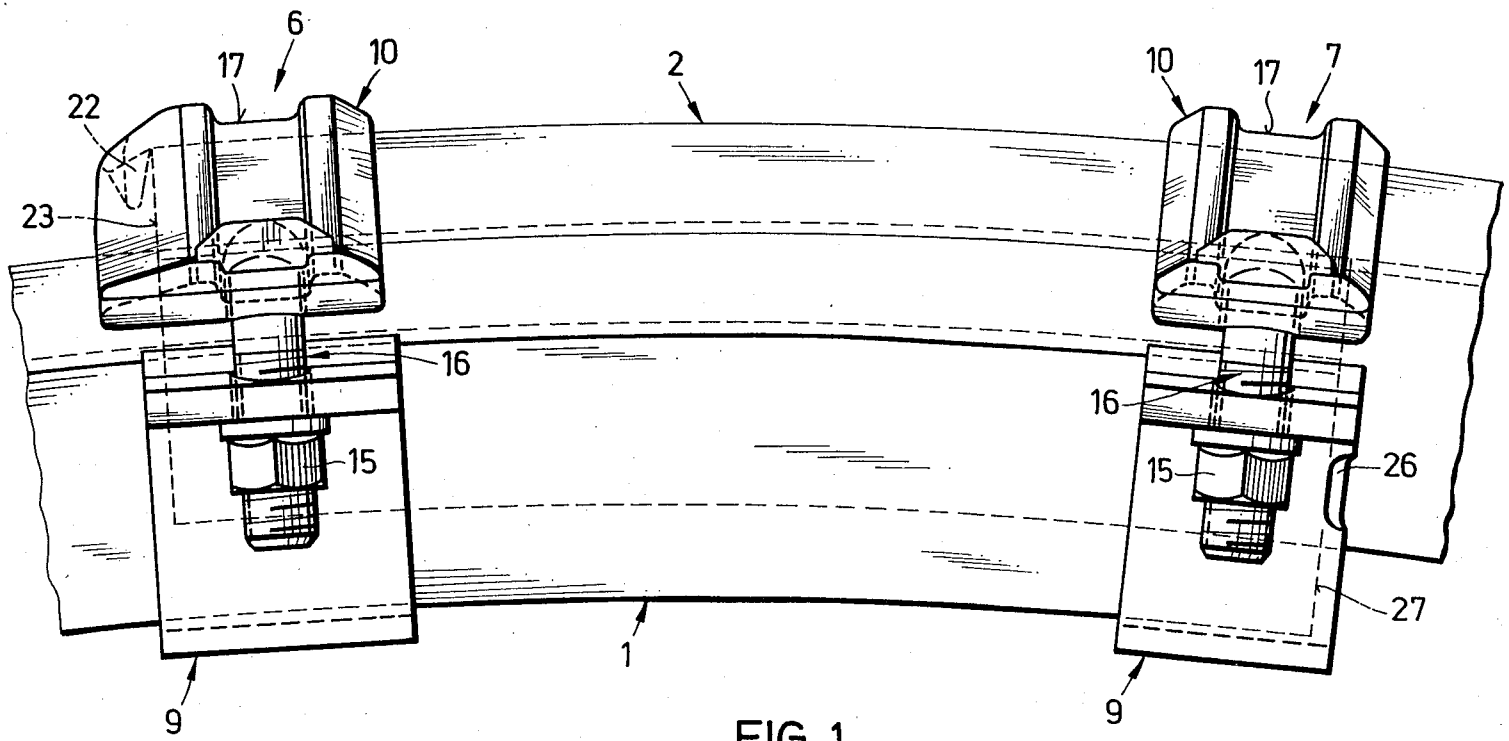
FIG. 1 is a partial side view of the overlapping region of two U-shaped profiled through sections of a sliding arch support with two clamping connections according to the invention.

Referring now to the drawings in detail and firstly to FIGS. 1–5 thereof, it will be seen that reference numerals 1 and 2 designate two through sections of a non-illustrated sliding arch support, lying one within the other. Such an arch support for use in underground excavations and the like is disclosed in U.S. Pat. No. 3,022,100 the entire disclosure of which is incorporated herein by reference.

Each through section 1, 2 includes a base 3, lateral webs or legs 4, and flanges 5 which are integral with each other. Flanges 5 of the upper through section 2 are positioned on the flanges 5 of the lower through section 1.

The clamping of through sections 1 and 2 in the extended overlap region of the sections at rock pressure is effected by means of two clamping connecting arrangements 6 and 7 which are respectively arranged at the end portions of both through sections 1 and 2.

The clamping devices 6 and 7 each includes a lower bending-resistant, U-shaped shackle or stirrup 9 abutting against grooved lower faces 8 of flange 5 of the lower through section 1, an upper shackle or stirrup 10 which overlaps the flanges 5 of the upper through bores 2, and connecting or clamping bolts 16 extended through boxes or openings 11 formed in the flanges 13 of the upper stirrup 10 and through bores 12 provided in the flanges 14 of the lower stirrup 9. In addition clamping nuts 15 are provided in connections 6, 7 to tighten the bolts 16.

Figure 4:
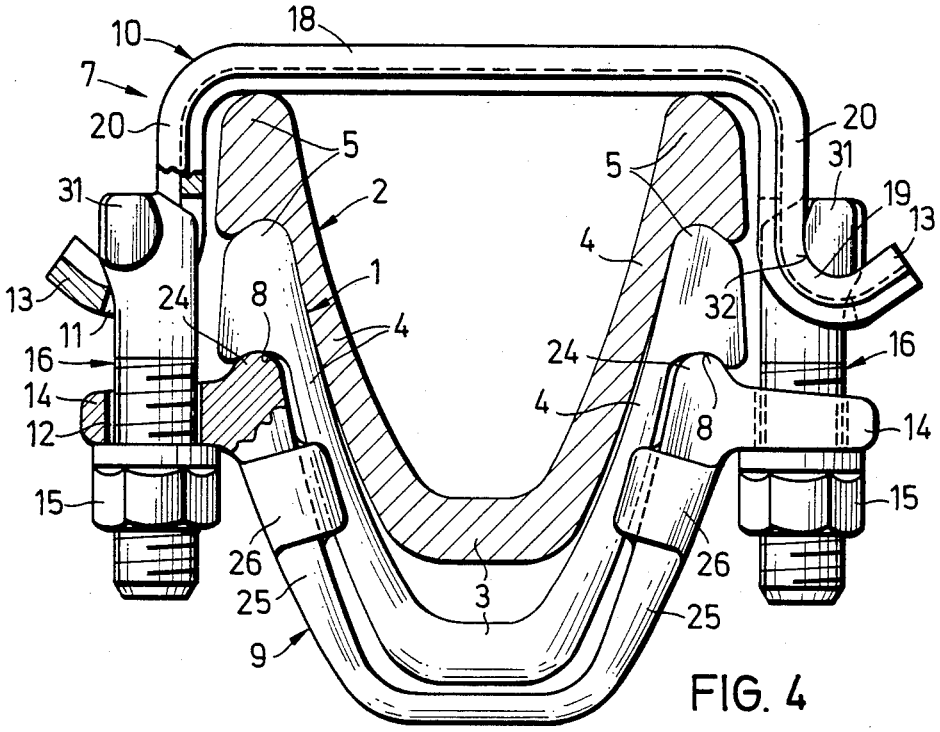
FIG. 4 is a vertical sectional view taken through line IV—IV of FIG. 3.
Figure 5:
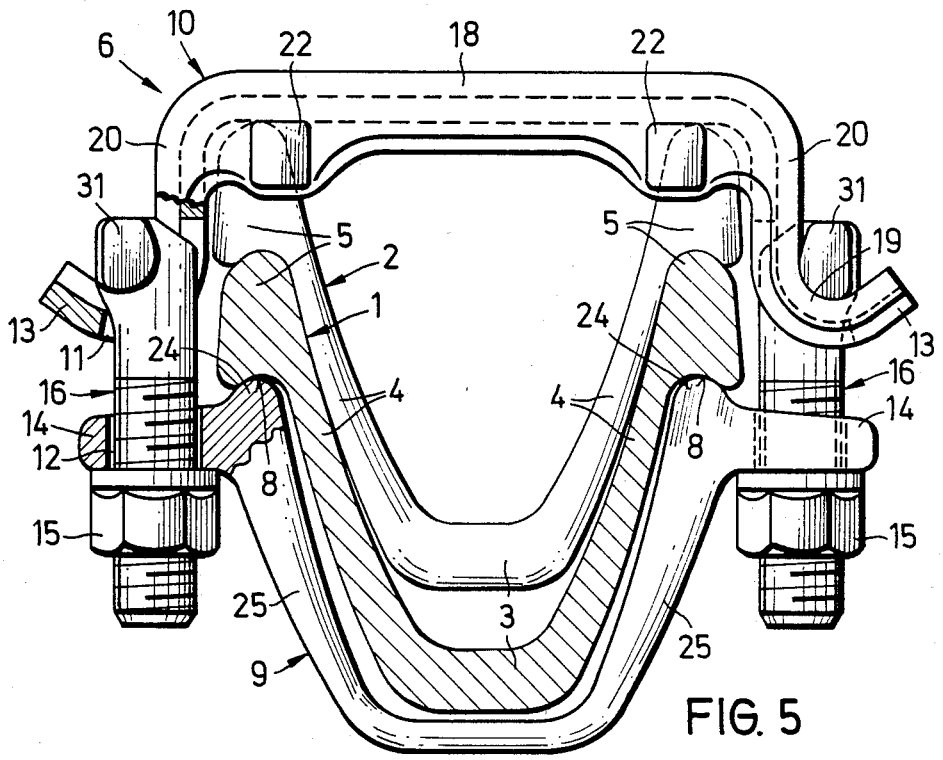
FIG. 5 is a vertical sectional view taken along line V—V of FIG. 2.

Flanges 13 of the U-shapely formed upper stirrup 10 having a longitudinal groove 10 are curved in the direction towards the longitudinal web 18 (FIGS. 4 and 5). The transition portions or zones between the curved flanges 13 and vertical legs or portions 20 of the upper stirrup 10 are also curved. The through openings 11 are formed so that they are predominantly positioned in the transition zones 19.

Figure 2:
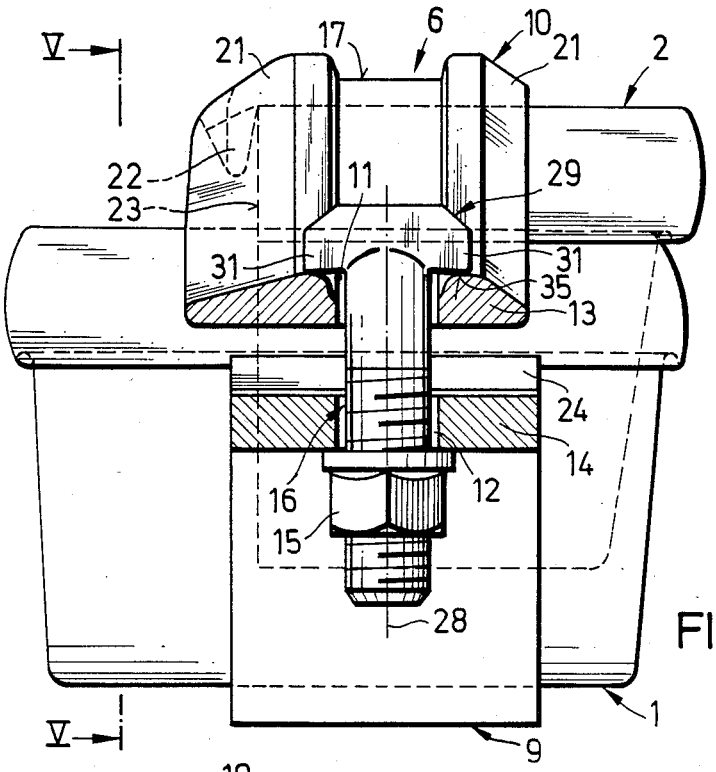
FIG. 2 is a front view, partially in section of the clamping connection of the through sections inserted one into the other, on an enlarged scale.
Figure 3:
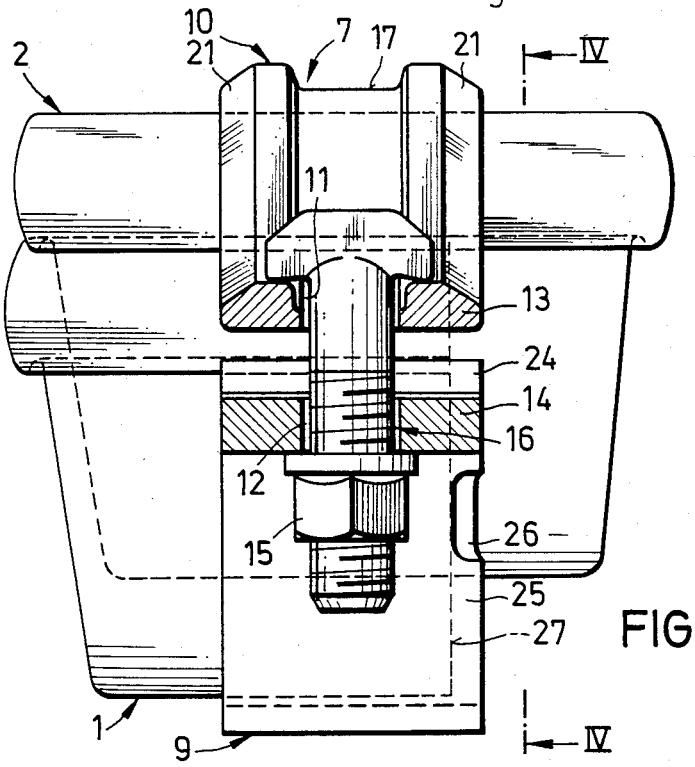
FIG. 3 is a front view, partially in section of the clamping connection mounted at the end portions of the clamped through sections.

As seen from FIGS. 1 through 3 the edge portions 21 of the upper stirrup 10 are oblique. Each oblique portion 21 is formed so that it is longer than the through section 2 which is in contact with the upper stirrup 10 (FIGS. 1 and 2). Two protruding projections 22 (FIG. 5) are formed on the lower edge of the upper stirrup 10, these projections in assembly abutting against the end faces of the flanges 5 of the upper through section 2 as clearly seen from FIG. 2 and FIG. 5.

The lower stirrups 9 each has a U-shaped cross-section and includes laterally outwardly extending flanges 14. Each lower stirrup has supporting ribs 24 which abut at surfaces 8 against the bases of the lower grooves provided in the flanges 5 of the lower through section 1. As shown in FIGS. 3 and 4, bent-over steps or abutments 26 are provided on the lateral webs or legs 25 of the lower stirrup 9, which webs abut against the end faces of two lateral webs 4 of the lower through section 1.

Figure 6:
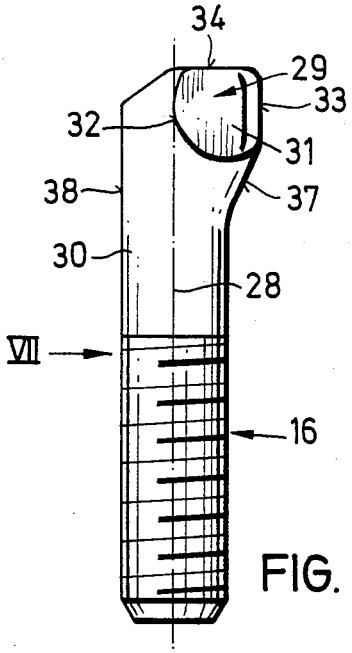
FIG. 6 is a side view of the clamping bolt.
Figure 7:
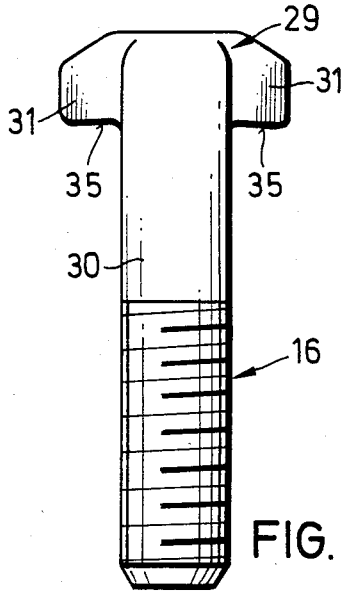
FIG. 7 is a view of the clamping bolt, as seen from arrow VII of FIG. 6.

With reference to FIGS. 6 and 7 it will seen that each clamping bolt 16 has a hammer head 29 which is a deformed portion of the bolt and which is laterally offset relative to a central axis of elongation 28, and a shaft 30.

Supporting projections 31 are provided on the hammer head 29. In the operative position (FIGS. 1 to 5) the hammer heads 29 of the clamping bolts 16 lie on the ends of the flanges 13 and extend approximately parallel to the through sections 1, 2.

Figure 8:
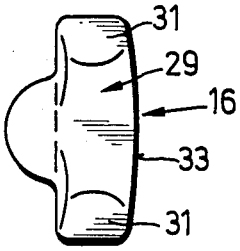
FIG. 8 is a top plan view of the bolt head.

FIGS. 4 through 6 show that supporting projections 31 lie on the transition zones 19 between the vertical portions 20 and curved flanges 13 of the upper stirrup 10 only with their convexly curved flange portions 32. The convexly curved flange portions 32 extend upwardly and merge into the end surface 33 and forwardly into the head surface 34 of the bolt head 29 (FIG. 6). As shown in FIG. 8 the end surface 33 of the bolt head 29 is convexly curved relative to the plane extended somewhat parallel to the surface 34.

Figure 9:
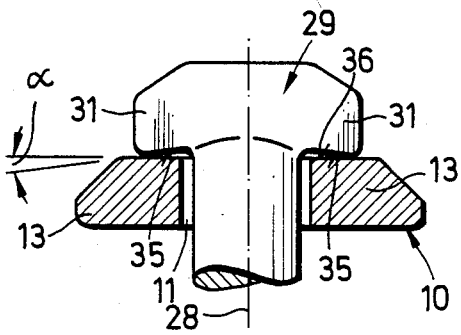
FIG. 9 is a side view of the bolt head and a bolt inserted into the flange of an upper clamping stirrup in the position in which a. clamping force is applied to the bolt.
Figure 10:
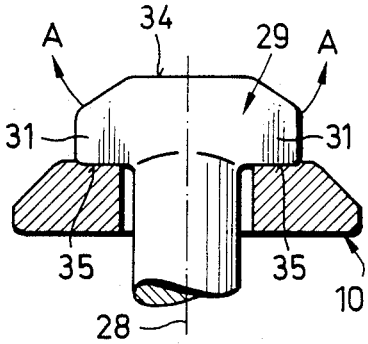
FIG. 10 illustrates a relative position of the bolt head and the flange of the upper clamping stirrup when a mine pressure is applied thereto, in addition to the clamping force.

The undersides of supporting projections 31, as particularly seen from FIGS. 9 and 10, are inclined at an angle 2, which is smaller than 90°, to the plane which is normal to the axis of elongation 28 of the bolt shaft. The opposing stops or abutments 36 of the upper stirrup 10 are straight-line and extend in the direction of elongation of the through sections 1, 2. Such a construction results in that, upon the application of the clamping force, the supporting projections 31 first abut against the upper stirrup 10 remotely from the through opening 31 (FIG. 9). If then a higher load is applied to the bolt head (FIG. 10) projections 31 deform according to arrows A in the direction towards the surface 34 so that the undersides 35 come into contact with the upper stirrup 10, and specific contact pressures are exerted on the upper stirrup.

FIG. 6 further clearly shows that the bolt shaft 30 in the region 37 below the bolt head 29 is inclined. This inclined region 37 merges into the end surface 33. The latter is corbelled from the shaft 30 and is formed by the radius which is preferably about $\frac{1}{3}$ smaller than the radius of the bolt shaft 30. Side 38 of the bolt shaft 30, facing the through sections 1, 2, extends up to the surface which is parallel to the upper surface 34 of the bolt head and extends somewhat in the middle of the height of the bolt head 29. Supporting projections 31 are inclined at the upper edges thereof.

Referring back to FIGS. 4 and 5 is will be seen that, upon the application of a clamping force to each clamping connection, manufacture plays between the clamping bolts 16 and the upper stirrup 10 are eliminated. The connection arrangements 6, 7 are strengthened by the torques of the bolts when through bores 11 come into contact with the bolt shafts 30.

It will be understood that each of the elements described above, or two or more together, may also find a useful application in other types of clamping connections for flanged through sections of support structures differing from the types described above.

While the invention has been illustrated and described as embodied in a clamping connection for flanged through sections of a support structure, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A clamping device for connecting at least two shaped elongated flanged through sections inserted one into another to form a support structure, comprising a U-shaped bending-resistant lower stirrup supported in flange recesses of a lower through section and having flange portions provided with through openings; an upper stirrup overlapping a flange of an upper through section and including a longitudinal web, lateral webs, and flange portions formed with through openings; clamping bolts extended through said openings of said upper stirrup and said lower stirrup; and clamping nuts for tightening said bolts, each bolt including a shaft having an axis, a hammer head integral with said shaft and being laterally offset relative to said axis, and a transition portion between said shaft and said head, said head having supporting projections having convexly curved portions, said flange portions of said upper stirrup having curved transition surfaces which engage said curved portions in a form-locking fashion in assembly, said projections having straight-line faces in the direction of elongation of said through sections, said through openings of the upper stirrup being formed in transition zones between said lateral webs and said flange portions and being adjusted to said bolts passing therethrough in the regions of said heads such that, before applying a clamping force to each bolt, said shafts are each positioned at a mounting-limited distance from a peripheral region of a respective through opening of the upper stirrup, adjacent an end of a respective flange portion, and after applying a clamping force to each bolt, due a relative displacement of said flange portion of said upper stirrup along said supporting projections of said hammer heads, said peripheral region of each through opening comes into contact with said transition portion of each bolt.

2. The clamping device as defined in claim 1, wherein said projections have undersides, which are inclined at an acute angle to the axis of said shaft.

3. The clamping device as defined in claim 2, wherein each supporting projection has an end face, said curved portion upwardly merging into said end face and forwardly merging into said straight-line face, said flange portions of said upper stirrup being bent toward said longitudinal web.

4. The clamping device as defined in claim 3, wherein said head has an end surface which includes the end faces of said projections and is convexly curved relative to a plane parallel to said straight-line faces.

5. The clamping device as defined in claim 4, wherein said transition portion is inclined to said axis and merges into said end surface of said head.

6. The clamping device as defined in claim 5, wherein said end surface projects from said shaft by an amount which is defined by a radius which is by about $\frac{1}{3}$ smaller than the radius of said shaft.

7. The clamping device as defined in claim 5, wherein each bolt has a back side facing said through sections, said back side extending vertically up to a plane extending through a half of the height of said head and parallel to said straight-line faces.

* * * * *